United States Patent [19]

Morris et al.

[11] Patent Number: 4,512,241

[45] Date of Patent: Apr. 23, 1985

[54] PLENUM/VACUUM CHAMBER WITH DUCT CONNECTION FOR INSTALLATION IN CABINET OF FIXTURE TO CONTROL AIR SUPPLY OR RETURN

[75] Inventors: Earl L. Morris, La Habra Heights; V. Walter Hafner, Whittier, both of Calif.

[73] Assignee: Acorn Engineering Company, City of Industry, Calif.

[21] Appl. No.: 455,751

[22] Filed: Jan. 5, 1983

[51] Int. Cl.[3] ..... F24F 13/00

[52] U.S. Cl. ..... 98/32; 98/108

[58] Field of Search ..... 98/40 D, 32, 108, 40 C, 98/38 R

[56] References Cited

U.S. PATENT DOCUMENTS

| | | | |
|---|---|---|---|
| 1,650,569 | 11/1927 | Nickle | 98/108 |
| 2,848,936 | 8/1958 | Vallero | 98/32 X |
| 3,124,903 | 3/1964 | Truhan | 98/40 D X |

*Primary Examiner*—William E. Wayner
*Assistant Examiner*—John Sollecito
*Attorney, Agent, or Firm*—Edgar W. Averill, Jr.

[57] ABSTRACT

A plenum/vacuum chamber for providing air circulation in a room. The chamber is attached to a housing affixed over an opening in the wall of the room and extends into the room. The housing has a grille passing therethrough which has an air-tight compartment around it.

10 Claims, 5 Drawing Figures

PLENUM/VACUUM CHAMBER WITH DUCT CONNECTION FOR INSTALLATION IN CABINET OF FIXTURE TO CONTROL AIR SUPPLY OR RETURN

BACKGROUND OF THE DISCLOSURE

The field of the invention is ventilation and the invention relates more particularly to the ventilating of rooms which have metal light or plumbing fixtures affixed to a wall. The invention is particularly applicable to installation in prison cells and rooms in mental institutions and other institutions where vandalism is a problem. Such locations have successfully used fixtures such as a lavatory fixture which is fabricated from stainless steel and which is affixed to a wall in a cell which has a pipe chase on the outside thereof so that the fixture can be serviced from the pipe chase without the necessity of entering the cell. The steps required to provide maintenance service in a prison cell are labor intensive. First, it must be understood that prison guards or security personnel are not permitted to do service or maintenance work. Furthermore, maintenance personnel are not trained or equipped to guard prisoners. Still further, tools which are required to perform maintenance are potentially capable of being used as weapons and it thus becomes necessary for the maintenance personnel to be kept separated from the prisoners. Therefore, even for a simple maintenance task it is necessary to first remove the prisoner or prisoners from the cell. Secondly, the maintenance man, accompanied by a security man enter the cell. A second security man may also be required to escort the maintenance man to the cell door. It can thus be seen that a task as ostensibly simple as changing a light bulb becomes a disruptive and labor intensive task if it must be done from within the cell. These steps are eliminated when service can be performed from the pipe chase where an unescorted service man may do the work.

Air ventilation systems have for years provided a problem for prison security. Such vents have been used as a hiding place for contraband and in some instances even as the source of an avenue of escape. Circulation of air has been provided by vents connecting the cell to the pipe chase. Then by providing either increased or decreased air pressure in the pipe chase, air is blown into or withdrawn from the cell through openings in the vent. Providing air inlet or air outlet from a source other than the pipe chase is often necessary to provide proper circulation. In most instances, a conventional air outlet grate was installed in a wall of the cell. Such grates are difficult to vandal proof. Also, if adjustment is provided for such grates, in the past this adjustment had to be accomplished from within the cell and this, in turn, has several disadvantages. First, if the adjustment required service personnel, as to balance air flow in a line of cells, the above disadvantages arose relating to labor cost. Secondly, if the adjustment can be made from the cell, it is more likely to be altered by the prisoner which can upset the air flow balance between cells on the same air supply or return line.

SUMMARY OF THE INVENTION

It is an object of the present invention to provide an adjustable and vandal resistant air supply device which can be mounted in the housing of a fixture such as a lavatory fixture, light fixture or the like which fixture is mounted on the wall adjacent the chase and the interior of which is accessible from the chase.

The present invention is for a plenum/vacuum chamber for providing air circulation to a room. The chamber is affixed to the housing of a fixture which housing is hollow and is securely affixable to an opening in a wall of a room. The housing extends into the room and has a grille formed in a wall thereof. The grille is formed from a plurality of openings formed through a portion of the housing wall and an air-tight compartment is sealingly affixed about the interior surface of the grille. The compartment chamber has an opening having means for connection to an air supply/return. The grille may be formed in the bottom of the housing when the housing is installed above the floor level. When the grille is formed in the bottom of the housing, the compartment may be formed by sealingly affixing a plate parallel to and above the bottom of the housing.

DESCRIPTION OF THE PREFERRED EMBODIMENTS

Figure 4:
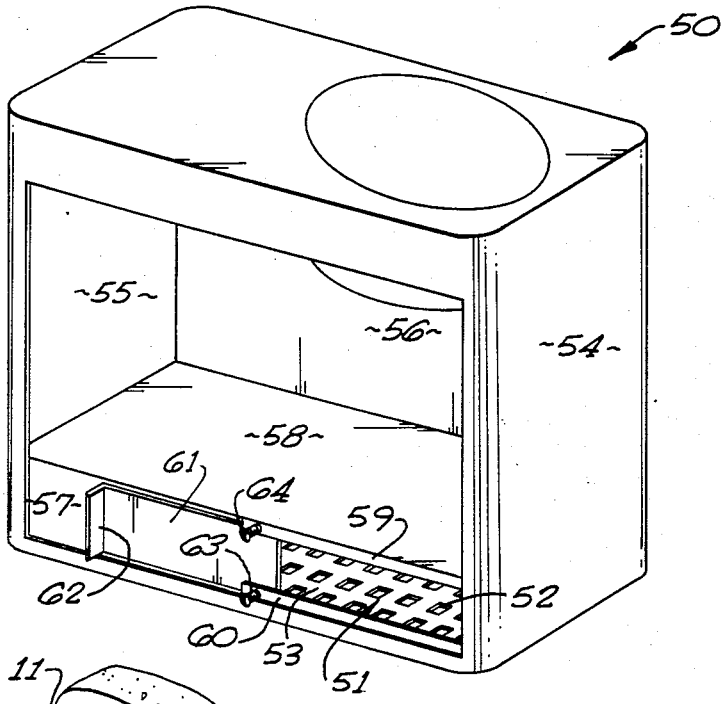
FIG. 4 is a perspective view showing an alternate embodiment of the plenum/vacuum chamber further including a damper.

A fixture such as a lavatory fixture 10 is securely mounted in the wall 11 of a room such as a prison cell. The housing 9 of fixture 10 is preferably fabricated from steel such as stainless steel and extends outwardly from wall 11 into the cell or room. On the reverse side of the wall from the cell is an area referred to as a pipe chase which consists of a narrow corridor which may be reached by service personnel but which is inaccessible from within the cell. Side 12 of wall 11 faces the pipe chase. Reference character 13 indicates a portion of the cell floor and 14 indicates a portion of the pipe chase floor. Housing 9 is securely affixed by nuts and studs or otherwise securely affixed to the wall.

Housing 9 is mounted above cell floor 13 which permits air flow through vent holes 16 in the bottom 17 of the housing 9. Bottom 17 is also fabricated from stainless steel and the vent holes may be square, round or other shapes which for uses such as prison cells should prevent the hiding of weapons and thus should be of a small diameter such as $\frac{1}{4}$ inch along the side. Square holes having $\frac{1}{4}$ inch sides being spaced $\frac{1}{4}$ inch apart have proved highly successful in this application as have round holes of this diameter. A plenum or vacuum chamber 18 is formed above vent holes 16 by a plate 19 which forms the top thereof and which is welded or otherwise sealingly affixed to side 20 and 21 of housing 9 and front 22. A back plate 23 completes the chamber and an air duct 24 forms means for connecting the plenum or vacuum chamber to a source of air. The air may either be supply air in which case chamber 18 is a plenum chamber for providing air which exits vent holes 16 into the cell. Alternatively, duct 24 may be a return air duct in which case chamber 18 becomes a vacuum chamber and air flows from the cell into chamber 18 and out of duct 24.

The housing 9 may serve both as an air supply and return device by the provision of a second vent formed by a plurality of openings 25 formed in the side 20 of housing 9. By providing air supply through duct 24 and further by reducing the pressure in the pipe chase a continual supply of air into and out of the cell may be accomplished.

Figure 2:
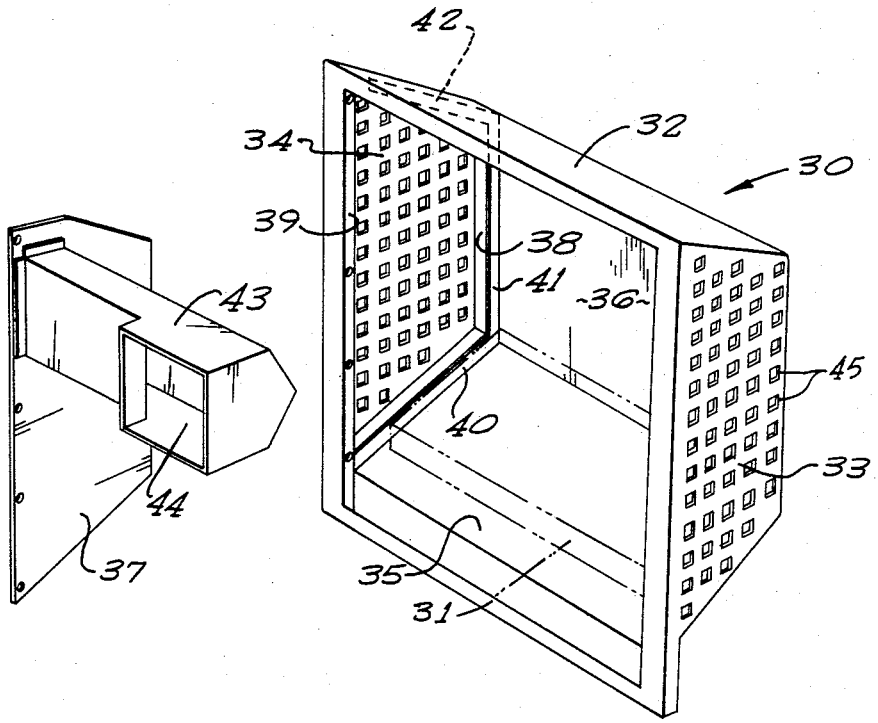
FIG. 2 is an exploded perspective view of an alternate embodiment of the plenum/vacuum chamber of the present invention.

The same concept of the present invention can be utilized with other fixtures, and a light fixture 30 is shown in perspective view in FIG. 2. Light 31 is indicated generally in phantom lines and schematically since it does form a part of the present invention. Light fixture 30 has a housing 29, a top 32, sides 33 and 34, bottom 35 and front 36. Like fixture 10, it is preferably fabricated from stainless steel or other structurally strong material if the installation is to be in a room where vandal resistance is important. Housing 29 should also be sealingly affixed to the wall of the room in which it is located. Where ducting is provided, the housing need not be sealed to the wall. The wall 37 of a plenum chamber 38 is shown separated from the chamber. Wall 37 is bolted into the side 39 and rests against flanges 40, 41 and 42. A duct 43 is welded to wall 37 and has an outlet 44 which can be connected to either a source of supply air or return air.

A second set of vent openings 45 could be formed in side 33 to provide circulation in the room. For instance if outlet 44 is connected to a source of supply air, vent openings formed through wall 33 would be able to provide return flow through the pipe chase on the reverse side of the wall in which light fixture 10 is mounted. It is, of course, necessary for installations utilizing the pipe chase as an air supply or return passageway that fixture 30 be sealingly attached to the wall.

Figure 3:
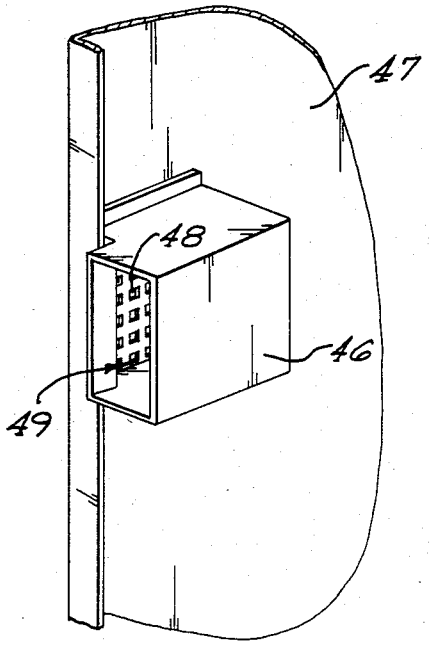
FIG. 3 is a fragmentary perspective view showing an alternate embodiment of the manifold of the plenum/-vacuum chamber of the present invention.
Figure 1:
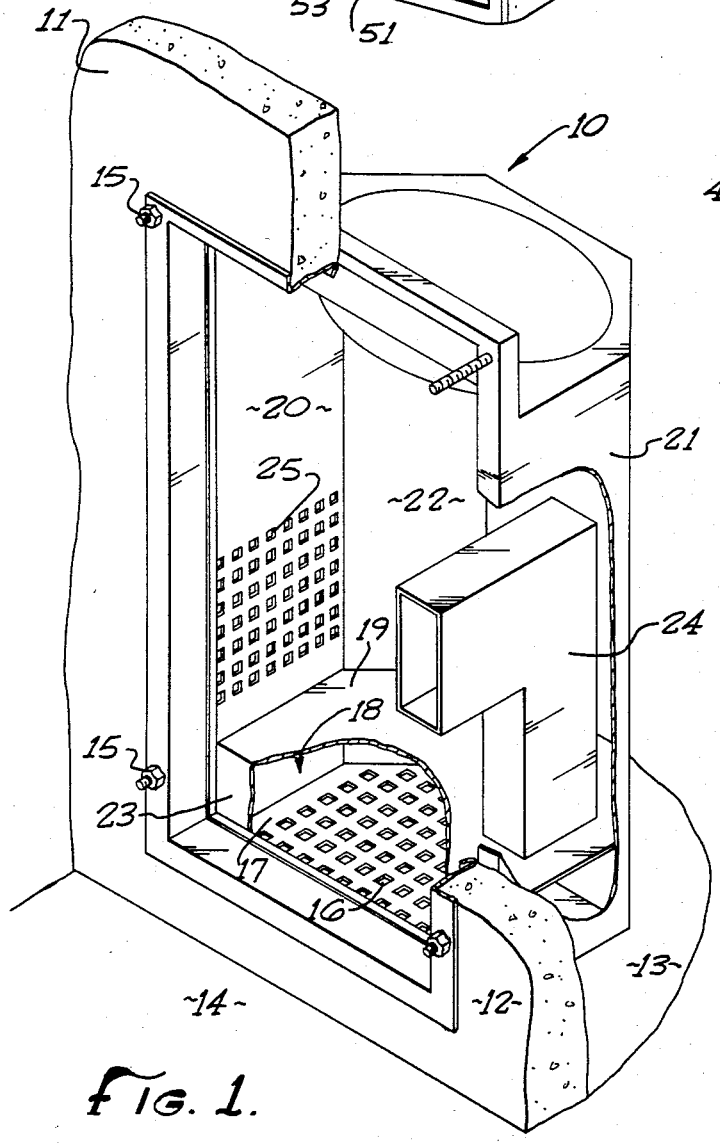
FIG. 1 is a perspective view partly broken away of the mounted plenum/vacuum chamber of the present invention.
Figure 5:
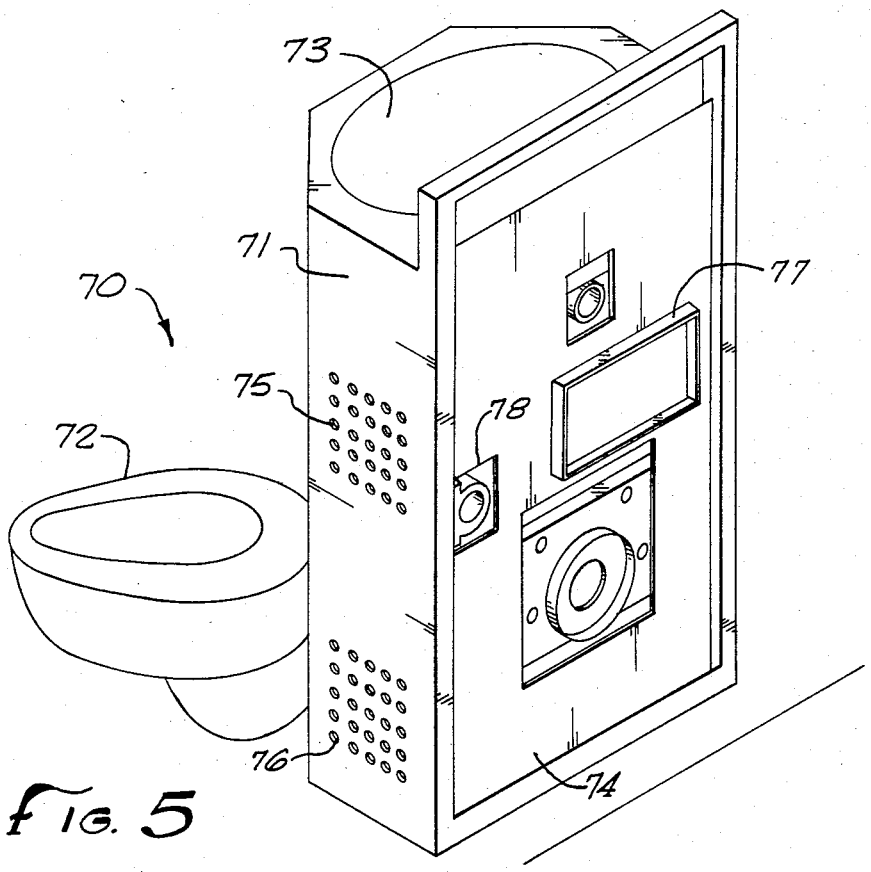
FIG. 5 is a perspective view of an alternate embodiment of the plenum/vacuum chamber of the present invention.

Alternate configurations of plenum or vacuum chambers are shown in FIGS. 3, 4 and 5. In FIG. 3, plenum or vacuum chamber 46 is welded to side 47 of a fixture. Square holes 48 are formed through side 47 and may be of ¼th inch on each sid spaced ¼th inch apart or may in stead may be circular holes of ¼th inch diameter or similar size which prevents the hiding of contraband. Air may flow into the cell or out of the cell through duct 49.

The air supply may be regulated by a damper such as that shown in fixture 50 of FIG. 4. A plenum or vacuum chamber 51 is formed in the bottom of the fixture which is formed above the vent openings 52 in the bottom 53 of fixture 50. The two sides 54 and 55 and the front 56 form three of the four sides of plenum/vacuum chamber 51 and the back 57 and top 58 form the remaining two sides. Top 58 and back 57 may be fabricated from a material of far lighter construction than the sides such as galvanized steel since these surfaces are not accessible to occupants of the cell or room.

A pair of channels 59 and 60 hold a damper 61 which is slideable to open and close the passageway into the plenum or vacuum chamber 51. A handle 62 facilitates this movement. A pair of tightening screws 63 and 64 both prevent vibration of the damper and also hold it in the desired position. In the fixture 50 of FIG. 4, no other vents are provided so that the air passage is from the plenum or vacuum chamber 51 into the pipe chase without the necessity of connection to an air duct.

An alternate embodiment of the present invention is shown in perspective view in FIG. 5 where lavatory and toilet fixture 70 has a housing 71 fabricated from stainless steel to which a toilet 72 is securely affixed. A sink 73 is formed in the top and the unit is adapted to be securely affixed to a cell wall adjacent an opening through the wall which leads to the pipe chase. A plate 74 is attached to the back of housing 71 and vent holes 75 and 76 provide an air flow path from the interior of housing 71 to the cell. A duct connection flange 77 provides a means to connect the unit to a source of supply or return air. Openings such as opening 78 should be closed off with duct tape or other sealing means.

It can be seen that the use of the plenum/vacuum chamber of the present invention is particularly efficient in those applications where fixtures are securely affixed to a wall and accessible from the back side of the wall as from a pipe chase. The provision of a compartment over openings in the fixture wall can completely replace the prior art ventillation outlet. In such installations, the necessity for constructing a separate opening through the wall for an air vent is completely eliminated and for such installations as prison cells, the cost of constructing such an opening is high because of the strength of the wall used and the necessity of making the vent vandal resistant.

The present embodiments of this invention are thus to be considered in all respects as illustrative and not restrictive; the scope of the invention being indicated by the appended claims rather than by the foregoing description. All chages which come within the meaning and range of equivalency of the claims are intended to be embraced therein.

What is claimed is:

1. A plenum/vacuum chamber for providing air circulation to a room comprising:

a hollow housing securely affixed over an opening in the wall of a room, said housing extending into said room;

a first grille formed in a wall of said housing, said grille being formed from a plurality of openings formed through a portion of the wall said grille having an exterior surface and an interior surface; and a second grille formed in a wall of said housing other than the wall of the housing in which said first grille is formed said second grille having an air-tight compartment sealingly affixed about the interior surface thereof, said compartment having an opening for connection to an air supply-return.

2. The plenum-vacuum chamber of claim 1 wherein said housing has at least one planar surface and said second grille is formed in said planar surface.

3. The plenum/vacuum chamber of claim 2 wherein said housing has a flat bottom and upwardly extending front and side walls and said second grille is formed in the bottom thereof.

4. The plenum/vacuum chamber of claim 3 wherein said air-tight compartment is formed by a plate sealingly affixed to the upwardly extending front and side walls of the housing and further includes a back wall extending upwardly from the bottom of the housing to the plate and sealingly affixed to the bottom of the housing and to the plate.

5. The plenum/vacuum chamber of claim 1 wherein said grille is formed in a portion of a side wall of the housing and said compartment is sealed to the interior surface of the wall thereof.

6. The plenum/vacuum chamber of claim 5 wherein said compartment has a rectangular side wall.

7. The plenum/vacuum chamber of claim 1 further including damper means affixed adjacent the opening for air supply return.

8. The plenum/vacuum chamber of claim 7 wherein said damper means comprises a flat plate slidingly moveable in and out of the air flow path to said opening for air supply/return.

9. The plenum/vacuum chamber of claim 1 wherein said air tight compartment is formed across the back side of the housing which is to be adjacent the opening in the wall over which the fixture is mountable.

10. The plenum/vacuum chamber of claim 1 wherein said second grille is formed in a portion of a side wall of the housing.

* * * * *